US005271725A

United States Patent [19]

Freet et al.

[11] Patent Number: 5,271,725

[45] Date of Patent: * Dec. 21, 1993

[54] SYSTEM FOR PUMPING FLUIDS FROM HORIZONTAL WELLS

[75] Inventors: Thomas G. Freet; Kurt P. McCaslin, both of Kingwood, Tex.

[73] Assignee: Oryx Energy Company, Dallas, Tex.

[ * ] Notice: The portion of the term of this patent subsequent to Oct. 13, 2009 has been disclaimed.

[21] Appl. No.: 868,718

[22] Filed: Apr. 14, 1992

Related U.S. Application Data

[63] Continuation of Ser. No. 600,008, Oct. 18, 1990, Pat. No. 5,154,588.

[51] Int. Cl.[5] ..... F04B 47/06

[52] U.S. Cl. ..... 417/423.3; 415/901; 417/572; 166/105.5

[58] Field of Search ..... 417/423.3, 423.5, 572; 415/901; 166/50, 68, 265, 369, 105.5

[56] References Cited

U.S. PATENT DOCUMENTS

| | | | |
|---|---|---|---|
| 1,428,238 | 9/1922 | Keating | 415/901 |
| 1,879,625 | 9/1932 | Mendenhall | 417/423.3 |
| 2,397,070 | 3/1946 | Zublin . | |
| 2,430,509 | 11/1947 | Hoover | 417/423.3 |
| 2,452,920 | 11/1948 | Gilbert . | |
| 2,492,141 | 12/1949 | Gaylord | 417/423.3 |
| 2,797,893 | 7/1957 | McCune et al. . | |
| 2,804,926 | 9/1957 | Zublin . | |
| 3,398,687 | 8/1968 | Yoshikawa | 417/423.3 |
| 3,624,822 | 11/1971 | Carle et al. . | |
| 3,974,878 | 8/1976 | Roeder . | |
| 4,072,481 | 2/1978 | Laval, Jr. . | |
| 4,126,406 | 11/1978 | Traylor et al. . | |
| 4,481,020 | 11/1984 | Lee et al. | 166/105.5 X |
| 4,838,353 | 6/1989 | Anders | 166/369 |
| 4,878,539 | 11/1989 | Anders | 166/303 |
| 5,154,588 | 10/1992 | Freet et al. | 417/572 |

FOREIGN PATENT DOCUMENTS

| | | |
|---|---|---|
| 0267445 | 5/1988 | European Pat. Off. . |
| 405570 | 2/1934 | United Kingdom . |
| 713872 | 8/1954 | United Kingdom . |
| 2000552A | 1/1979 | United Kingdom . |
| 2097473A | 11/1982 | United Kingdom . |
| 2117049A | 10/1983 | United Kingdom . |
| 2192230A | 1/1988 | United Kingdom . |

OTHER PUBLICATIONS

"Electrical Submersible Pumps for the Montrose Field,"SPE 10388.1, by A. R. Way and M. A. Hewett.

"Engineers Evaluate Submersible Pumps in North Sea Field", *Petroleum Engineer Int'l*, Jul. 1982, A. R. Way and M. A. Hewett.

"Handling Sand and Gas", *The Oilman*, Feb. 1984, by Eldon Drake.

"Development and Field Test Results of an Efficient Downhole Centrifugal Gas Separator", *Journal of Petroleum Technology*, Jul. 1985, by L. S. Kobylinski, F. T. Taylor and J. W. Brienan.

"An Overview of Horizontal Well Completion Technology", SPE 17582, by R. E. Cooper and J. C. Troncoso.

"Electrical Submersible Pumps in Horizontal Wells", by Andrew Gallup, Robert Marshall and B. L. Wilson.

"Artificial Lift in the Montrose Field, North Sea", *SPE Production Engineering*, Aug. 1989, By E. G. Jacobs.

Paper Presented at 1990 ESP Workshop in Houston, Texas, Apr. 30–May 2, SPE—Gulf Coast Section, North Side, by Keith Way, Kerin Welte and Nathan Kapsch.

*Primary Examiner*—Richard A. Bertsch
*Assistant Examiner*—Roland G. McAndrews, Jr.
*Attorney, Agent, or Firm*—Pravell, Hewitt, Kimball & Krieger

[57] ABSTRACT

Apparatus and method for pumping fluids from horizontal wells with a dip tube used without requiring a packer in the well. Gas is separated from the liquid phase ahead of the pump to avoid slug flow of gas into the pump. This increases the amount of oil that can be pumped from the well by avoiding shutdowns resulting from gas-locking of the pump.

18 Claims, 3 Drawing Sheets

SYSTEM FOR PUMPING FLUIDS FROM HORIZONTAL WELLS

This is a continuation of application Ser. No. 07/600,008 filed Oct. 18, 1990 now U.S. Pat. No. 5,154,588.

BACKGROUND OF THE INVENTION

1. Field of the Invention

The present invention relates an apparatus and method for increasing the efficiency of pumping liquids from wells which are substantially deviated from the vertical direction. More particularly, the apparatus is attached to the lower end of a tubing in a well or to the casing, contains a submersible electrical or other type pump and provides a method for separating gas and liquid before the liquid reaches the pump.

2. Discussion of Related Art

The production of oil and other liquids from the earth through wells often requires the use of pumps in the wells to force the liquids to the surface of the earth. There are many designs of subsurface pumps, all of which are powered by either mechanical, hydraulic or electrical means.

The efficiency of pumps for pumping liquid from wells is often decreased by the presence of gas simultaneously produced with the liquid, especially when large amounts of gas are present. Various designs of apparatus have been used to attempt to separate the gas from the liquid to be pumped from a well. Preferably, the gas is produced to the surface through a separate conduit which bypasses the pump. In rod-pumped wells, for example, it is common practice to pump the well through the tubing in the well and leave the annulus between the tubing and casing open so that gas can flow up the annulus.

In wells pumped by electrical power, it is particularly important to decrease the amount of gas entering the centrifugal pumps utilized. Excessive amounts of gas may cause extra wear of the pumps, decrease the efficiency of pumping and, above a certain ratio of gas to liquid, cause the pump to "gas lock," or stop pumping. At this point the motor must be shut down quickly to avoid overheating, since cooling of the motor is primarily by flow of liquid past the housing of the motor. Automatic shutdown in the event of gas locking is commonly provided with the submersible electric pumps used in wells. After a pre-selected time, the pumps restart automatically. The cycling off and on from automatic shutdowns decreases the amount of fluid that can be pumped and causes loss of production from the well.

Several types of apparatus are used with electrical submersible pumps to decrease the amount of gas entering the pump. The types can be generally classified as static and rotating. The static devices include: (1) a shroud over the pump, which is placed below perforations in a well and (2) a "reverse-flow" gas separator, which causes the flow to reverse direction above the perforations in the wellbore, separating some of the free gas from the liquid. These devices are helpful, particularly at lower flow rates. The rotating devices are called "rotary gas separators," "centrifugal liquid-gas separators," or "centrifugal gas separators." The article "Development and Field Test Results of an Efficient Downhole Centrifugal Gas Separator," by L. S. Kobylinski et al, *J. of Pet. Tech.*, July, 1985, pp. 1295– 1304, provides a review of the operation on these type devices in vertical wells and wells deviated from vertical up to 56 degrees. Deviated wellbores had no effect on the performance of the centrifugal gas separators in these wells.

Centrifugal separators for submersible pumps are described in U.S. Pat. Nos. 3,624,822 and 4,481,020. They operate by causing the liquid-gas mixture to flow in spiral motion, thereby causing the liquid to separate from the gas. The liquid is then removed from near the wall of the device and sent to the inlet of the pump. The gas is removed from the center of the spiral and discharged through a port to the outside of the separator. An article K. Way, Kevin Welte and N. Kapsch, presented at the 1990 Electric Submersible Pump Workshop sponsored by Society of Petroleum Engineers, Gulf Coast Section, April 30–May 2, Houston, Tex., describes modifications to the electric submersible pump system that have extended application of the system to wells where very high levels of free gas exist at pump intake conditions. Use of multiple rotary gas separators ahead of a pump is one modification that has been successful in some cases.

In recent years, there has been a great increase in the number of wells drilled for oil production which are deviated from vertical by more than 75 degrees over a portion of the wellbore, and it is not uncommon for wells to be drilled in a direction near 90 degrees from vertical for hundreds of feet. For purposes of the present invention, we define any well drilled for a substantial distance, say approximately 150 feet, at an angle from vertical of more than about 75 degrees as a horizontal well. These wells are drilled to achieve greater rates of oil production, to decrease the amount of unwanted gas or water production, and for other purposes well known in industry. The wells are typically drilled in a vertical direction to a certain depth and then "kicked off" from vertical in the desired vertical and azimuth directions. The curved portion of the well is called the dogleg or build angle portion. The radius of the curved portion typically varies from as small as 30 feet to as much as 3000 feet.

The process of pumping fluids from horizontal wells presents difficult problems unless the pressures in the well are great enough to achieve desired production rates with the pump set in the vertical section of the well. Even then, pumping is difficult when large volumes of gas are produced with the liquids. Electrical submersible pumps, which are particularly suited for pumping at high rates and often are needed since the wells are capable of producing at high rates, present a particularly difficult problem because the standard pumps will not pass through a portion of the well where the radius is less than about 500 to 800 feet without possible damage to the pump. In larger radius wells, electrical submersible pumps have been operated in the horizontal portion or other straight portions of deviated wells when they can be placed at the desired location without damaging the pump. The article "Electrical Submersible Pumps in Horizontal Wells," by A. Gallup et al, *Oil & Gas J.*, Jun. 18, 1990, provides a survey of the Subject of producing horizontal wells with electrical submersible pumps. Special steps such as drilling a larger hole, drilling a straight section between the vertical and horizontal portions (called the "tangent section") and drilling the horizontal section with a continuous downhill inclination are recommended for increasing the effectiveness of electrical pumps in horizontal wells.

It has been found that another particularly troublesome problem in pumping horizontal wells is that gas is often produced from the horizontal portion of the well in slugs. The problem can be severe in wells where long intervals are at near 90 degrees from vertical or where local high intervals are created during the drilling of the well. A slug of gas can enter the pump, even when the pump is equipped with a rotary gas separator, and the gas will often cause the pump to become gas-locked. This phenomenon can occur when the well is producing at a gas-to-liquid ratio that, on average, would not cause frequent pump shutdowns in a vertical well. Gas-locking of the pump will cause loss of production by causing the pump to cycle off and on. It is not possible to size or otherwise design the pump and rotary gas separator adequately for slugging conditions.

Electrical submersible pumps can be operated with a "stinger" or "tailpipe" attached to the inlet of the pump. The tailpipe allows fluid intake at a distance below the pump. An example of such well equipment is described in the article "An Overview of Horizontal Well Completion Technology," by R. E. Cooper et al, SPE Paper No. 17582, presented in November, 1988. Tail pipes are often attached below packers in a well. An electrical submersible pump can be connected to the tail pipe at the packer.

There is a severe limitation to methods which require placement of packers in deviated wells. Even if the packer is designed to be movable or retrievable, there is always the risk that the packer will become stuck and require very expensive retrieval operations or loss of the well. Also, the depth of the pumping equipment in the well cannot normally be changed without the extra expense of retrieving the packer.

All systems proposed in the past for pumping horizontal wells which produce gas along with the liquid add significantly to the cost of the well or the cost of operating the well. There is a great need for a system for pumping a horizontal well without the addition of expensive drilling or completion steps, which allows simple variations of pumping intake location as conditions in the well change, and which alleviates or eliminates the slugging flow problem that is detrimental to the pumping process.

SUMMARY OF THE INVENTION

A system is provided that is low risk for pumping a horizontal well with an electrical submersible or other type of pump that is located remote to the distal end of the horizontal well. A length of tubing (dip tube), preferably closed at the distal end and containing fluid entry ports, is placed in the deviated portion of the well. A shear joint may be placed at the top of the dip tube. A swage is used to attach the shear joint or dip tube to a shroud or a length of liner which contains the pump. In one embodiment of the invention, the shroud is supported in the well by tubing extending to the surface and the shroud contains an electrical submersible pump. Gas-liquid separation occurs in the annulus outside the dip tube and at the entrance to the perforations in the dip tube. In another embodiment, the shroud contains a vent hole or holes near the top of the shroud, the shroud being supported in the well by tubing, and a seal is present between the vent holes and the intake port of a rotary gas separator attached to the pump. In a third embodiment the shroud is open at the top and is supported by the casing through use of a liner hanger.

In all embodiments in which the shroud is supported by tubing, a shroud-hanger having sufficient strength to support the shroud and the dip tube is attached at the bottom of the tubing to be placed in the well. In all embodiments, the dip tube is generally run into the horizontal well to a position as close to the distal end as practical, which allows fluid entry to the pump from near the end of the well and eliminates or substantially decreases the slugs of gas which cause problems in pumping the well. The pump may be placed in the vertical, tangent, or horizontal section of the well, but preferably is placed in a section of the hole having a dogleg severity of less than 1 degree per 100 feet to avoid flexure of the pump shaft during operation.

DESCRIPTION OF PREFERRED EMBODIMENTS

Liquid-gas separator apparatus and methods described herein are particularly suited for use with submersible electrical pumps in oil-producing wells. They will be described in that application, but it will become apparent that the principles of the invention are also applicable to other means of pumping liquid from a horizontal well, such as hydraulic pumps or rod-driven pumps.

Figure 1:
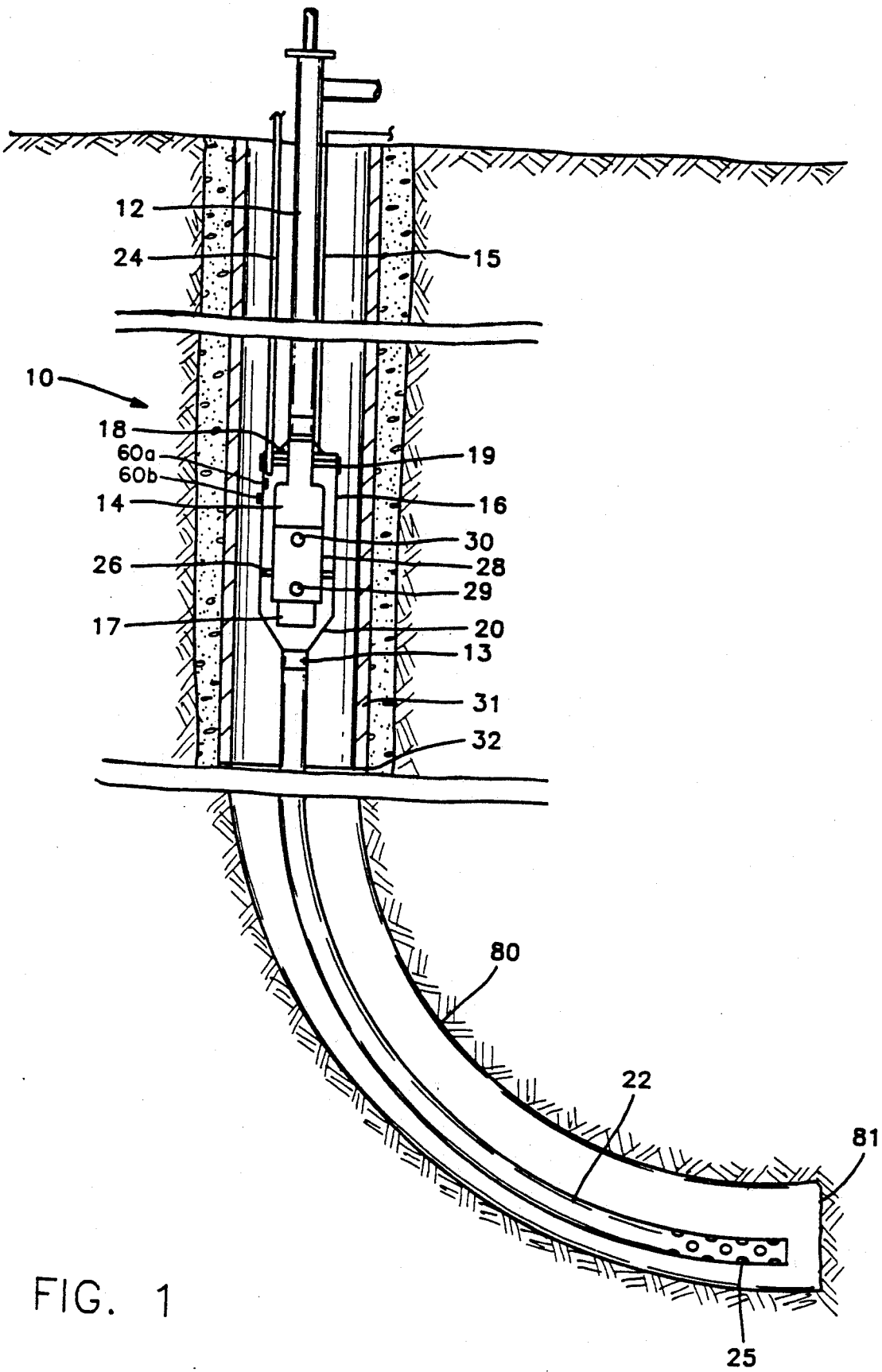
FIG. 1 is a longitudinal sectional view illustrating the gas-liquid separator apparatus in accordance with a first embodiment of the invention in which a shroud having a vent and containing a gas separator and pump is supported in the well by tubing.

FIG. 1 illustrates a preferred form of the liquid-gas separator apparatus 10 in accordance with a first embodiment of the invention. The apparatus is supported in the well by the tubing string 12, and is attached to form a hydraulic seal to the bottom joint of the tubing string 12 on the surface before placing the tubing in the well. The upper end of tubing string 12 extends to the surface of the well where it is supported by the wellhead using well known techniques. The apparatus 10 includes a pump 14, this being normally an electrical submersible pump being powered through an electrical cable 15, the pump 14 being attached to a shroud 16 at the top of the shroud. The shroud 16 comprises a length of tubular material having an inside diameter large enough to accommodate a pump and an outside diameter small enough to pass through the casing 31. A conduit for gas 24 connects the internal volume of the shroud 16 to the annulus outside the tubing 12 or to the surface. Connected to the pump 14 and powered by the same motor 17 is a centrifugal liquid-gas separator 28, having an inlet port 29. Liquid discharge from the gas-liquid separator 28 passes internally to the pump 14 while gas is preferentially discharged through the port 30 into the shroud and then through the conduit 24 to the annulus or to the surface.

The shroud 16 is attached to a shroud hanger 18, preferably by a flange 19, but threads or other means of attachment to obtain a hydraulic seal and mechanical strength are suitable. The shroud hanger 18 is preferably threaded directly on to the tubing 12, but may be welded or otherwise attached to the tubing. The shroud hanger must be designed to support the weight of the shroud 16, the pump 14, the motor 17, the dip tube 22 and other parts of the apparatus. The pump is preferably connected to the shroud hanger by a threaded connection, but other means of connection may be used. A swage 20 at the bottom of the shroud allows joining the shroud to the dip tube 22, the joining means between the shroud and swage 20 preferably being by threads or welding. A shear sub 13 is preferably placed between the swage 20 and the dip tube 22. The shear sub is a coupling hydraulically sealed by elastomer and containing a pin which can be sheared for recovery of the apparatus above if the dip tube 22 becomes stuck in the well. The dip tube 22 is preferably closed on the distal end not attached to the swage and preferably contains holes 25 disposed from a position near the closed end and extending a selected distance along the tube, the holes being for the entry of fluid into the dip tube. The dip tube may be formed from tubular materials identical to those used for the tubing 12 or different diameters and wall thicknesses may be selected for particular applications. The couplings of the material in the dip tube are preferably flush with the outside diameter of the tube. The diameter and wall thickness of the dip tube are selected such that the tube will bend to allow lowering the tube through existing bends in the casing and to the desired horizontal distance along the wellbore.

The optimum diameter of the dip tube is large enough to obtain an acceptable pressure drop and resulting release of gas from solution inside the dip tube 22 at the rates based on the pumping capacity of the pump 14 and not so large as to inhibit liquid-gas separation and flow of gas along the annulus outside the dip tube 22. The sizing will be selected for each well based on operating characteristics of the well, the rotary gas separator and the pump. Pressure sensors 60A and 60B (not shown) may be placed inside the shroud or in the annulus outside the shroud to aid in sizing the dip tube 22, the conduit 24 and the characteristics of the rotary gas separator and pump employed. Pressure gages adapted for downhole use are well known in industry. They may be electrically operated, either self-contained and battery driven or driven through a conductor cable extending to the surface of the earth, or they may consist of a small gas-filled tube extending to surface and connected to a conventional pressure gage on the surface of the earth. Since there is no packer in the well, the tubing and gas-liquid separator apparatus can be lowered and raised in the well to optimize pumping conditions as the conditions in the well change.

The casing 31 has a lower end 32. Below the casing 31 the section 80 may be an open hole or a liner may be used. A liner may be slotted, drilled or perforated to allow fluid entry to the well, in accord with well known techniques in industry. The end of the well 81 is referred to herein as the distal end.

In the annulus outside the dip tube 22 and as fluid enters the fluid entry ports 25 in the dip tube 22, gas tends to break out of the liquid and flow up the annulus outside the dip tube, past the shroud and through the vertical section of the wellbore to the surface. Liquid and gas flow through the dip tube and into the inlet port 29 of the rotary gas separator 28 attached to the pump. Primarily liquid flows through the pump 14 and through the tubing 12 to surface. Any gas separated from the liquid in the liquid-gas separator 28 is discharged through the outlet port of the rotary gas separator 30 and thence to the tubing-casing annulus or to the surface through the conduit 24. The conduit 24 may be perforations through the wall of the shroud or may be a length of smaller diameter tubing which extends from partially to the surface to entirely to the surface of the earth. The optimum length will be selected based on characteristics of the rotary gas separator and calculated or measured pressures inside and outside the shroud.

The hydraulic seal 26 is not required in all applications. The rotary gas separator 28 provides an increase in fluid pressure. Hydraulic conditions between the inlet port 29 and the discharge port 30 and between the discharge port 30 and surface may be such that separation of inlet and discharge streams does not require a seal.

Figure 2:
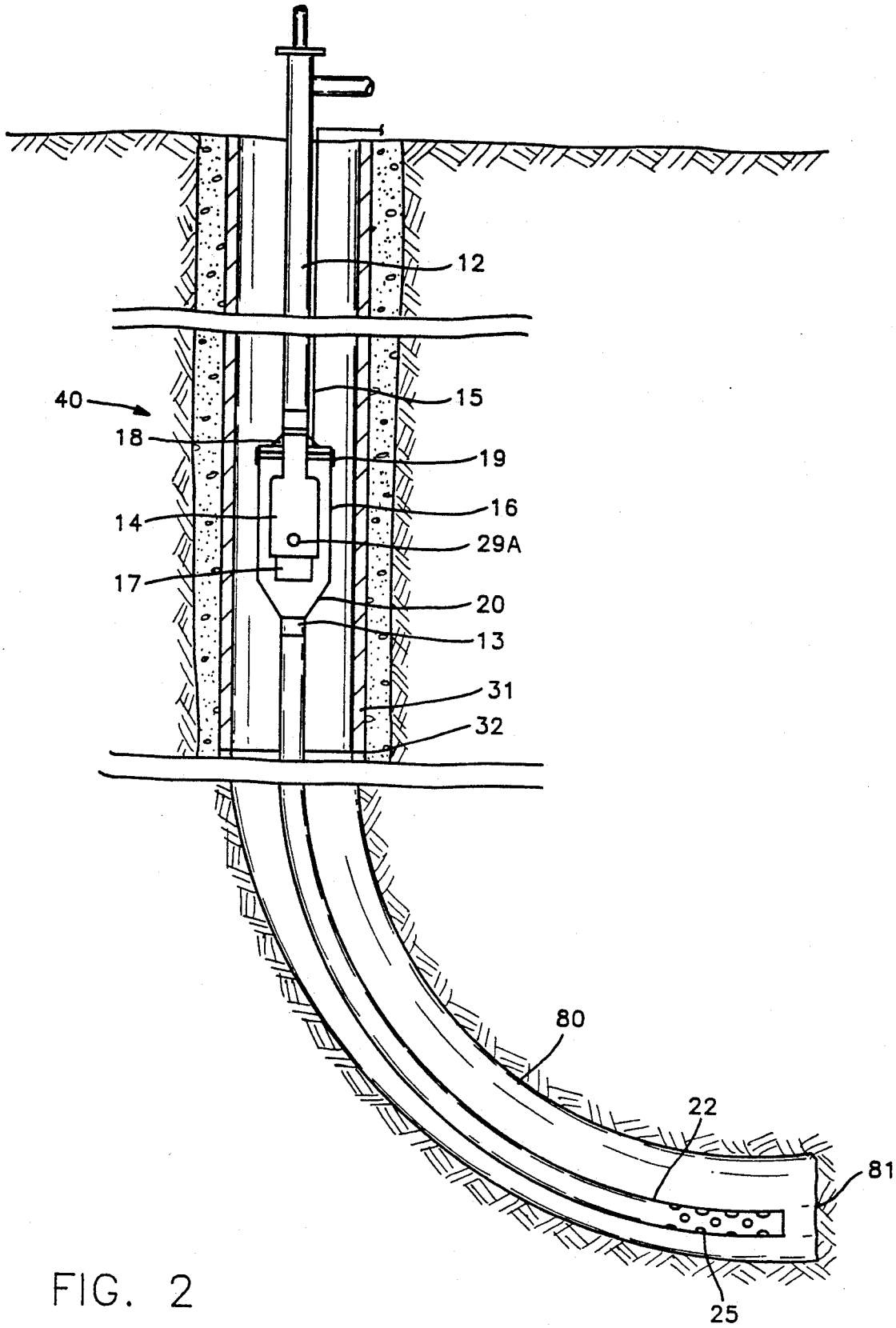
FIG. 2 is a longitudinal sectional view illustrating the gas-liquid separator apparatus in accordance with a second embodiment of the invention in which a shroud containing a pump is supported in the well by tubing.

In a second embodiment of this invention, shown in FIG. 2 at 40, the rotary-gas separator is not used and gas-liquid separation occurs in the annulus outside the dip tube 22 and at the entrance to the fluid entry ports 25. The tubing 12 supports the shroud 16 through the shroud hanger 18 and flange 19. The pump 14, having an inlet port 29A, is normally an electric submersible pump, but may be powered hydraulically or mechanically by rods. If it is electrical, a cable 15 brings power to an electric motor 17. A swage 20 is connected to the shroud 16 and to the shear sub 13. The dip tube 22 is connected to the shear sub 13. Liquid and a small amount of gas flow through the dip tube 22, the pump 14, and the tubing 12 to surface. Gas separated in the annulus outside the dip tube 22 flows around the shroud 16 and to surface. The gas flowing up the dip tube 22, either as free gas or gas that comes out of solution in the oil because of pressure drop in the dip tube, is not so great as to substantially decrease the efficiency of the pump 14. The gas slugging into the pump is practically eliminated by the dip tube 22 being located near the distal end of the wellbore. The dip tube 22 may also be located in the well such that ports for fluid entry 25 are located in a lower part of the horizontal wellbore, such that the wellbore efficiency for gas-liquid separation is increased. Well surveying techniques for determining the location of such lower parts of the wellbore are well known in industry. The apparatus can be raised or lowered in the well to optimize performance by operations not requiring retrieval of a packer or movement of a packer in the well.

Other numerals used in FIG. 2 have the same meaning as in FIG. 1.

Figure 3:
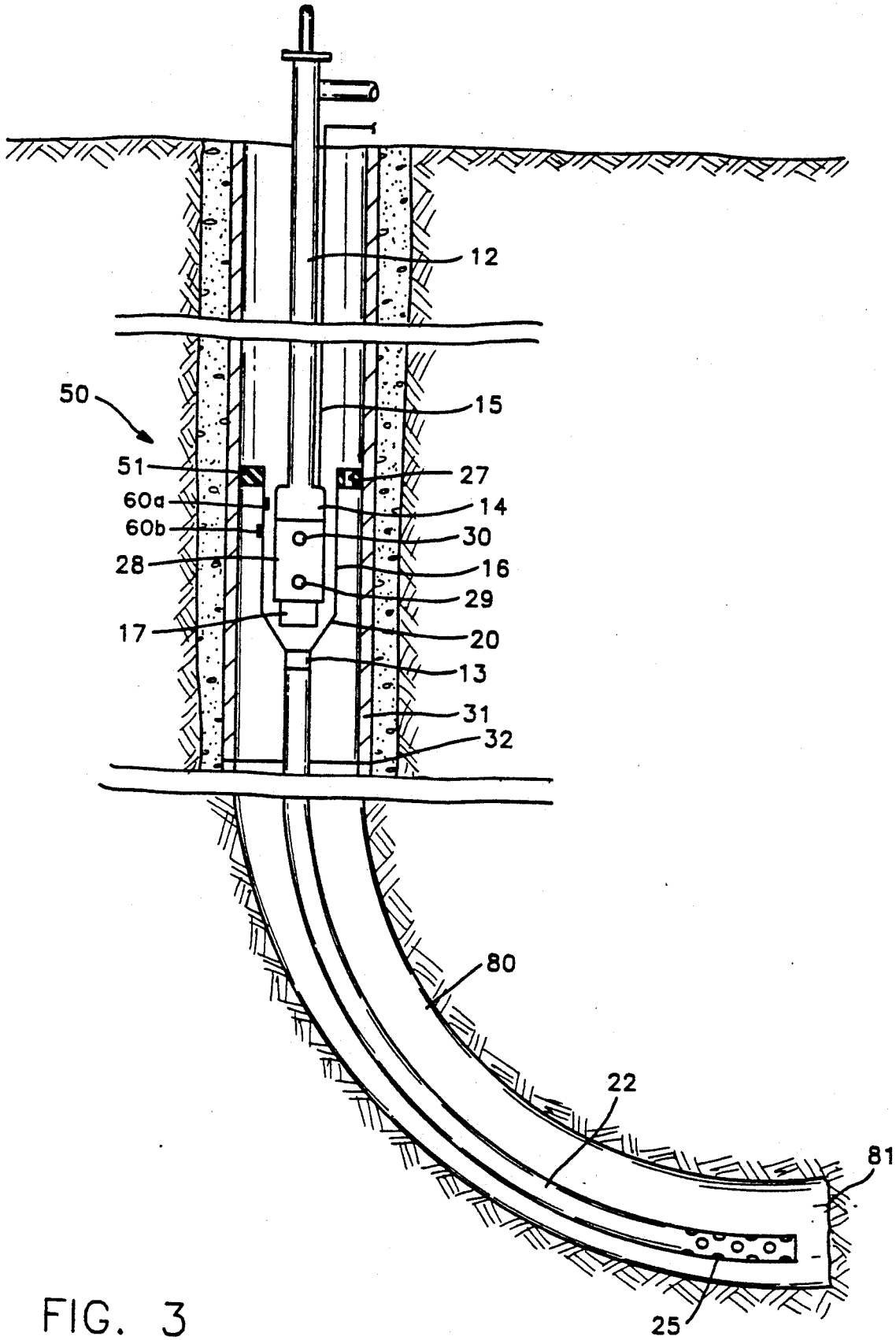
FIG. 3 is a longitudinal sectional view illustrating the gas-liquid separator apparatus in accordance with a third embodiment of the invention in which the shroud is supported in the well by casing.

In a third embodiment of this invention, shown in FIG. 3 at 50, the shroud is supported by the casing 31 having a lower end 32. Below the end of the casing 32 the segment 80 is an open hole or a liner of conventional design. The shroud 16 is open at the top and is connected to a liner hanger 51. The liner hanger 51 is used to transfer the weight of the shroud 16 and the dip tube 22 to the casing 31. The liner hanger 51 is preferably retrievable, in that it can be "set" to transfer the weight of the shroud 16 to the casing 31, and it can later be released, or unset, to transfer the weight of the shroud back to a pipe string used for retrieving the shroud from the well. The liner hanger 51 contains a vent 27 which allows gas or liquid to enter the annulus between the tubing 12 and the casing 31 and to flow to surface. Alternatively, or in combination, the shroud 16 has holes (not shown) near the top which allows gas to enter the annulus outside the tubing 12. Near the bottom of the shroud 16 the pump 14 and a centrifugal liquid-gas separator 28 are placed, supported by tubing 12 and powered through cable 15 to an electrical motor 17. The centrifugal liquid-gas separator has inlet port 29 and gas discharge port 30. The dip tube 22 has inlet ports 25 which are placed in the wellbore at a location to optimize gas-liquid separation in the annulus outside the dip tube. Generally, the inlet ports 25 will be placed near the distal end of the wellbore 81, but the inlet ports may be placed in a local low interval in the open hole or liner 80. The shroud 16 and dip tube 22 are sized such that excessive pressure drop does not occur in the dip tube to cause more solution gas evolution as oil flows through the tube 22 than can be handled by the centrifugal liquid-gas separator 28 and the pump 14. Pressure gages 60A and 60B adapted for downhole use and well known in industry may be placed inside the shroud and in the annulus outside the shroud or tubing to determine optimum design and location of the shroud 16 and dip tube 22 for the pump to be employed in the well. The top of the shroud 51 is placed high enough in the well to insure that flow in the shroud will be from bottom to top and past the electrical motor 17, such that the motor is adequately cooled.

In all embodiments described, tubing and other equipment is placed in wells using rigs and rig equipment which are well known in industry.

While preferred embodiments and application of this invention has been shown and described, it will be apparent to those skilled in the art that many more modifications and Variations are possible without departing from the inventive concepts herein described. The invention is, therefore, not to be restricted except as is made necessary by the prior art and the appended claims.

We claim:

1. Apparatus for separating gas and liquid and pumping the liquid from a horizontal well having a casing therein comprising:

(a) a first and second string of tubing, each string having an upper and a lower end, the first string having an inlet port and the second string extending to the surface of the earth;

(b) a shroud, the shroud formed of a cylindrical wall and a bottom end wall only;

(c) means for supporting the shroud inside the casing;

(d) a pump having an inlet port and means for attaching with hydraulic seal the pump to the lower end of the second string of tubing; and (e) means for attaching with hydraulic seal the bottom end wall of the shroud to the upper end of the first string of tubing.

2. The apparatus of claim 1 wherein the pump is an electrical submersible pump having an inlet port and an outlet port.

3. The apparatus of claim 1 further comprising a centrifugal liquid-gas separator attached to the inlet port of the pump to separate gas and liquid.

4. The apparatus of claim 1 further comprising a shear sub between the lower end of the shroud and the upper end of the first string of tubing.

5. The apparatus of claim 1 wherein the port for fluid entry into the first string of tubing is located in proximity to the distal end of the well.

6. The apparatus of claim 1 wherein the port for fluid entry into the first string of tubing is located in a low segment of the well.

7. The apparatus of claim 1 additionally comprising pressure gages in the well for measuring pressure conditions during pumping.

8. Apparatus for separating gas and liquid and pumping the liquid from a horizontal well comprising:

(a) a first and second string of tubing, each string having an upper and a lower end, the first string having an inlet port and the second string extending to the surface of the earth;

(b) a shroud having an upper end and a lower end and a vent for venting gas outside the shroud, the shroud enclosing a pump and motor connected thereto for driving the pump and enclosing a liquid-gas separator means having an inlet fluid port and an outlet port for gas upstream of the pump, the vent of the shroud being above the inlet fluid port of the liquid-gas separator means, so as to allow discharge of the gas from the outlet port of the separator means through the vent;

(c) means for attaching and hydraulically sealing the upper end of the shroud and the pump to the lower end of the second string of tubing; and (d) means for attaching and hydraulically sealing the lower end of the shroud to the upper end of the first string of tubing.

9. The apparatus of claim 8 wherein the pump is an electrical submersible pump having an inlet port and an outlet port.

10. The apparatus of claim 8 further comprising a hydraulic seal in the shroud outside the liquid-gas separator means and between the inlet fluid port and the outlet port for gas of the liquid-gas separator means.

11. The apparatus of claim 8 wherein the shroud vent has attached thereto a conduit for conveying gas.

12. A method of pumping fluids from a horizontal well having a casing therein comprising:

(a) placing a first tubing string having an inlet port in the well;

(b) attaching the first tubing string to a shroud;

(c) placing the shroud and a liner hanger attached thereto in the well at a selected depth and setting the liner hanger in the casing; and (d) attaching a submersible pump driven by an electrical motor and having an inlet port to a second tubing string and placing the pump and the second tubing string in the well at a depth such that the pump is inside the shroud.

13. The method of claim 12 further comprising the step of attaching a centrifugal liquid-gas separator to the inlet port of the pump to separate gas and liquid.

14. The method of claim 12 further comprising the step of placing a shear sub between the first string of tubing and the shroud.

15. The method of claim 12 further comprising the step of placing pressure gages in the well to measure conditions during pumping of the well.

16. The method of claim 12 wherein the inlet port for fluids in the first tubing string is placed at a location in the well to enhance gas-liquid separation outside the first tubing string.

17. The method of claim 12 wherein the top of the shroud is placed at a depth such that fluid flows through the shroud from bottom to top past the electrical motor.

18. A method of separating gas and liquid and pumping the liquid from a horizontal well comprising the steps of:

(a) placing in the well a first tubing string having an inlet port for fluids;

(b) attaching the first tubing string to a shroud containing an electrical submersible pump, the pump having liquid-gas separator means having an inlet fluid port and an outlet port for gas attached thereto upstream of the pump, the shroud having a vent for venting gas above the inlet fluid port of the liquid-gas separator means so as to allow discharge of the gas from the outlet port of the separator means through the vent;

(c) attaching the shroud to a second tubing string;

(d) placing the shroud containing the pump and the second tubing string in the well; and (e) powering the pump from the surface to pump liquid from the well.

* * * * *